US007909783B2

(12) United States Patent
Mayer et al.

(10) Patent No.: US 7,909,783 B2
(45) Date of Patent: Mar. 22, 2011

(54) FOOT COMPRESSION SYSTEM

(75) Inventors: Matthew J. Mayer, Grand Junction, CO (US); Peter E Von Behrens, San Francisco, CA (US); David M. Mayer, Grand Junction, CO (US); Gerhard B. Rill, Parachute, CO (US)

(73) Assignee: Leap Frogg, LLC, Grand Junction, CO (US)

( * ) Notice: Subject to any disclaimer, the term of this patent is extended or adjusted under 35 U.S.C. 154(b) by 0 days.

(21) Appl. No.: 12/499,473

(22) Filed: Jul. 8, 2009

(65) Prior Publication Data

US 2010/0010398 A1 Jan. 14, 2010

Related U.S. Application Data

(60) Provisional application No. 61/078,847, filed on Jul. 8, 2008.

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 7/00*** | (2006.01) |
| ***A61H 19/00*** | (2006.01) |

(52) U.S. Cl. ..... 601/29; 601/104

(58) Field of Classification Search ..... 601/27–31, 601/104, 148–150; 36/141
See application file for complete search history.

(56) References Cited

U.S. PATENT DOCUMENTS

| | | | | |
|---|---|---|---|---|
| 3,917,261 | A * | 11/1975 | Small et al. | 482/8 |
| 4,299,206 | A * | 11/1981 | Hofstein | 482/4 |
| 4,721,101 | A * | 1/1988 | Gardner et al. | 601/152 |
| 4,856,496 | A | 8/1989 | Chursinoff | |
| 5,584,798 | A * | 12/1996 | Fox | 601/152 |
| 5,682,690 | A | 11/1997 | Chang | |
| 5,931,797 | A * | 8/1999 | Tumey et al. | 601/152 |
| 6,685,661 | B2 * | 2/2004 | Peled | 601/149 |
| 6,893,409 | B1 * | 5/2005 | Lina | 601/152 |
| 7,282,038 | B2 * | 10/2007 | Gillis et al. | 601/151 |
| 7,618,382 | B2 * | 11/2009 | Vogel et al. | 601/7 |
| 2004/0064974 | A1 * | 4/2004 | Schuster | 36/91 |
| 2005/0187496 | A1 * | 8/2005 | Ho | 601/15 |

* cited by examiner

*Primary Examiner* — Justine R Yu
*Assistant Examiner* — Kristen C Matter
(74) *Attorney, Agent, or Firm* — Snell & Wilmer L.L.P.

(57) ABSTRACT

Methods and systems for dynamic compression of venous tissue enable improved blood movement in the extremities. In accordance with an exemplary embodiment, a pressure pad provides a compressive force to the venous plexus region of the foot. The pressure pad is successively withdrawn and re-pressed against the foot. Improved blood circulation may reduce the occurrence of undesirable complications such as deep vein thrombosis, ulcers, and the like.

23 Claims, 8 Drawing Sheets

FOOT COMPRESSION SYSTEM

CROSS-REFERENCE TO RELATED APPLICATIONS

This application claims priority to and the benefit of U.S. Provisional Patent Application No. 61/078,847 filed on Jul. 8, 2008 and entitled "FOOT COMPRESSION SYSTEM," wherein such provisional application is hereby incorporated in its entirety, by reference.

TECHNICAL FIELD

The present disclosure generally relates to systems and methods for ensuring that a person experiences proper blood flow within his or her feet and/or legs, and specifically to systems and methods for compressing the venous plexus region in the arch of the foot and the superficial veins of the top of the foot to stimulate blood flow.

BACKGROUND

In order to enhance circulation in a person's body, particularly in the feet and legs, periodic or cyclic compression of tissue, such as plexus regions of the foot, at predetermined timed intervals is beneficial. Under normal circumstances, blood moves up the legs due to muscle contraction and general movement of the feet or legs, such as when walking. If a person is immobilized, unable to move regularly, or has poor circulation brought on by disease, the natural blood return mechanism is impaired, and circulatory problems such as ulcers and deep vein thrombosis can occur.

To mitigate these problems, it is desirable to concentrate a compression force against veins throughout the legs and/or feet. Current systems are primarily based on pneumatic compression devices that squeeze the entire foot, calf, or thigh. These systems require significant power, and are inefficient because they provide high levels of force across the entire foot or leg rather than focusing in on those areas with the highest concentration of blood vessels. In addition, these systems may include air bags that can rupture at the seam, especially with high pressure within the bag.

In various current devices, tethered air lines limit mobility, and can lead to injury should the person attempt to walk while the device is in use. Further, existing devices may not be suited for continuous usage. Users cannot walk with them, or move away from the compression unit. The device must be removed before a user can walk. Additionally, current devices lack the ability to track and report user usage and compliance. Also, most pneumatic devices are quite noisy and can cause irritation of the skin leading to ulcers.

SUMMARY

A foot compression system is configured to apply pressure to a foot. In an exemplary embodiment, a foot compression system comprises an actuator portion configured to deliver a compressive force to the venous plexus region of the foot. The actuator portion comprises a retractable pressure pad. The foot compression system further comprises a reader portion configured to transmit commands to the actuator portion.

In another exemplary embodiment, a method comprises moving a pressure pad a first time to bring the pressure pad into contact with a foot to compress a portion of the foot, moving the pressure pad a second time to bring the pressure pad out of contact with the foot to allow the portion of the foot to at least partially refill with blood, and moving the pressure pad a third time to bring the pressure pad into contact with the foot to force at least a portion of the blood out of the portion of the foot.

In another exemplary embodiment, a tangible computer-readable medium has stored thereon, computer-executable instructions that, if executed by a system, cause the system to perform a method. The method comprises moving a pressure pad a first time to bring the pressure pad into contact with a foot to compress a portion of the foot, moving the pressure pad a second time to bring the pressure pad out of contact with the foot to allow the portion of the foot to at least partially refill with blood, and moving the pressure pad a third time to bring the pressure pad into contact with the foot to force at least a portion of the blood out of the portion of the foot.

BRIEF DESCRIPTION OF THE DRAWINGS

The subject matter of the present disclosure is particularly pointed out and distinctly claimed in the concluding portion of the specification. The present disclosure, however, both as to organization and method of operation, may best be understood by reference to the following description taken in conjunction with the claims and the accompanying drawing figures, in which like parts may be referred to by like numerals:

DETAILED DESCRIPTION

Details of the present disclosure may be described herein in terms of various components and processing steps. It should be appreciated that such components and steps may be realized by any number of hardware and/or software components configured to perform the specified functions. For example, a foot compression system may employ various medical treatment devices, input and/or output elements and the like, which may carry out a variety of functions under the control of one or more control systems or other control devices. In addition, details of the present disclosure may be practiced in any number of medical or treatment contexts, and exemplary embodiments relating to a deep vein thrombosis treatment system as described herein are merely a few of the exemplary applications. For example, the principles, features and methods discussed may be applied to any medical or other tissue or treatment application.

Figure 1:
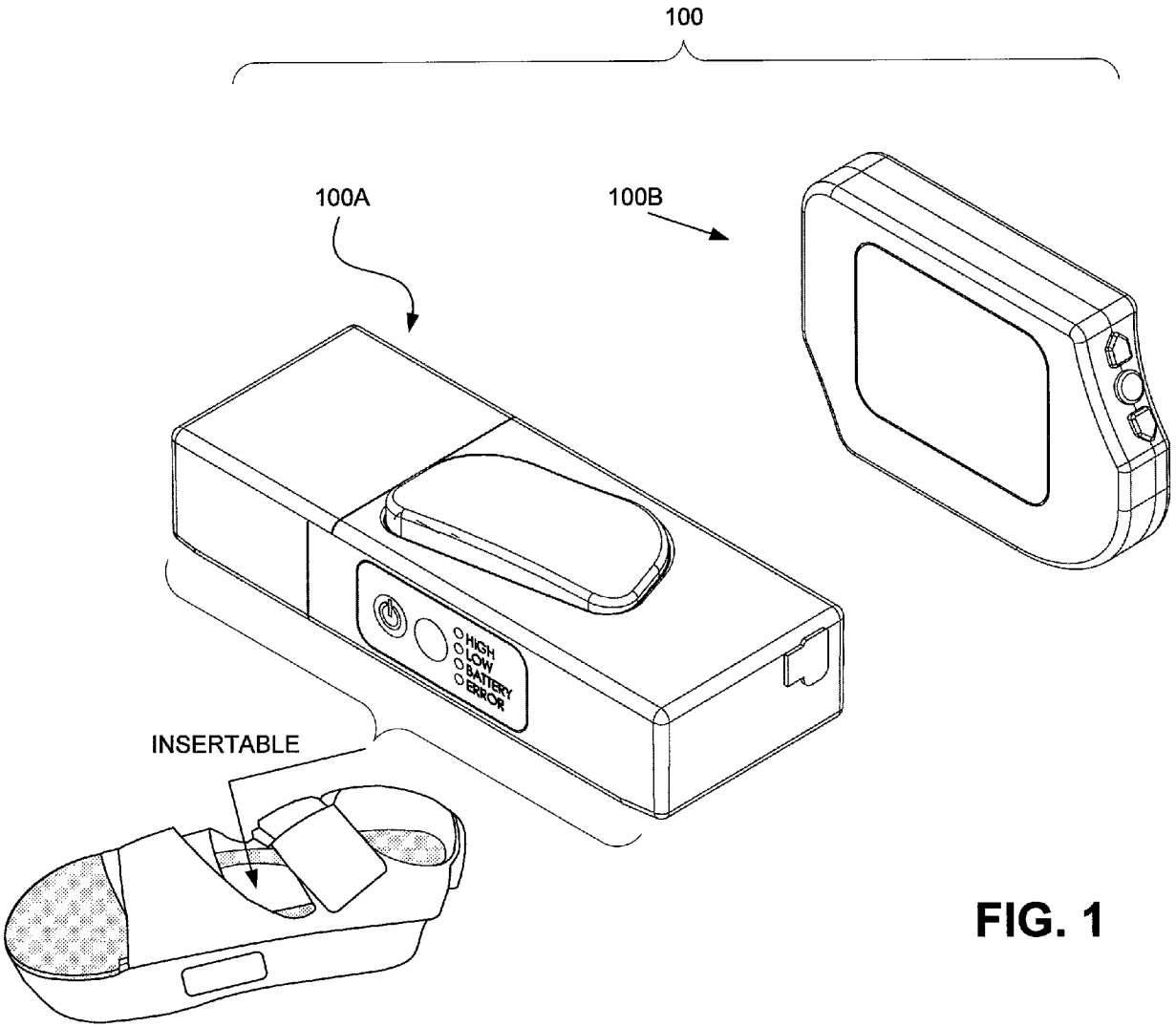
FIG. 1 illustrates a foot compression system in accordance with an exemplary embodiment.

A foot compression system may be any system configured to deliver a compressive force to a portion of a living organism, for example a human foot. With reference now to FIG. 1, and in accordance with an exemplary embodiment, a foot compression system 100 comprises actuator portion 100A and reader portion 100B. Actuator portion 100A is configured to deliver a compressive force to a foot responsive to communication with reader portion 100B. Moreover, a foot compression system may be configured with any appropriate components and/or elements configured to deliver a compressive force to a portion of a living organism.

With further reference now to FIGS. 2A-2B, 3, and 4A-4C, and in accordance with an exemplary embodiment, actuator portion 100A comprises main housing 102, pressure pad 104, electric motor 106, gearbox 108, output gears 110, main gears 112, slip clutch 116, electrical components 118, and weight sensor 120. Reader portion 100B comprises control box 130, batteries 132 (not shown in figures), display 134, and inputs 136.

Actuator portion 100A may be any device, system, or structure configured to apply a compressive force to a foot. In an exemplary embodiment, actuator portion 100A is configured to be removably located in the sole area of a shoe, sandal, or any other type of footwear product. In other exemplary embodiments, actuator portion 100A may be integrated into an item of footwear. Actuator portion 100A may also be a stand-alone unit, for example a footrest.

In various exemplary embodiments, actuator portion 100A has an outer shape at least partially defined by a main housing 102. Main housing 102 may be formed of metal, plastic, composite, or other durable material. Main housing 102 is configured to enclose various portions of foot compression system 100.

Figure 2A:
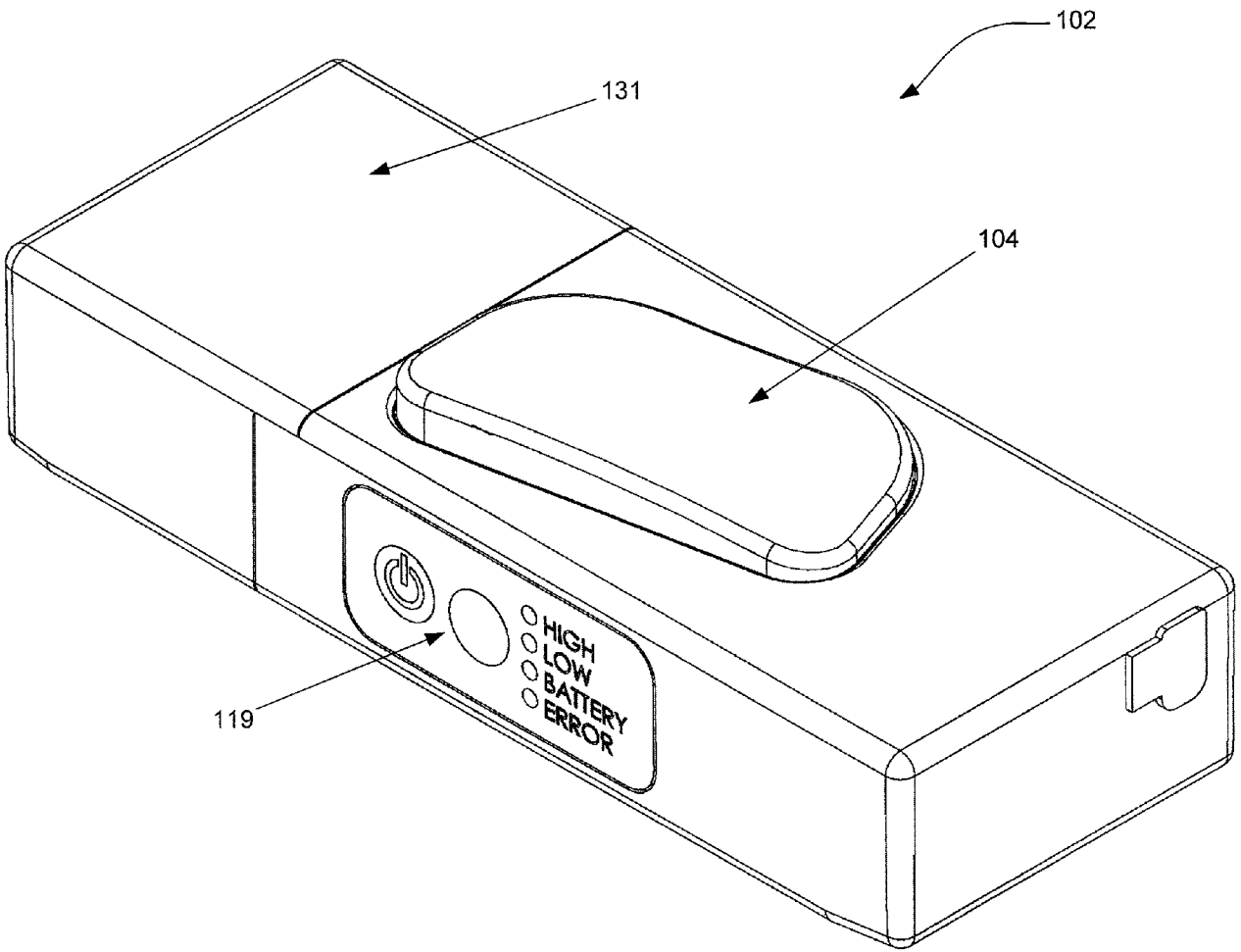
FIG. 2A illustrates an actuator portion of a foot compression system in accordance with an exemplary embodiment.
Figure 2B:
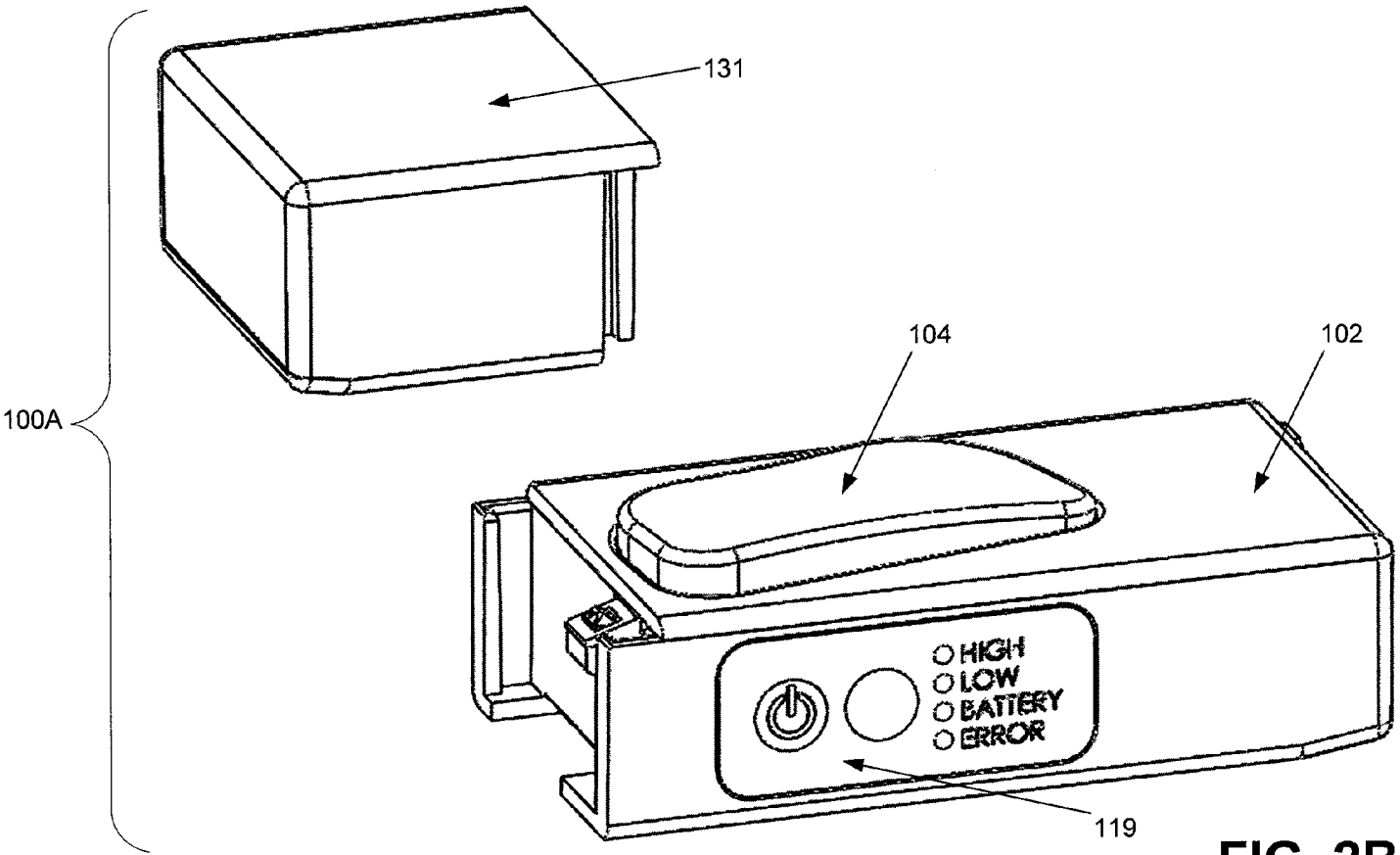
FIG. 2B illustrates an actuator portion of a foot compression system with a battery detached in accordance with an exemplary embodiment.
Figure 3:
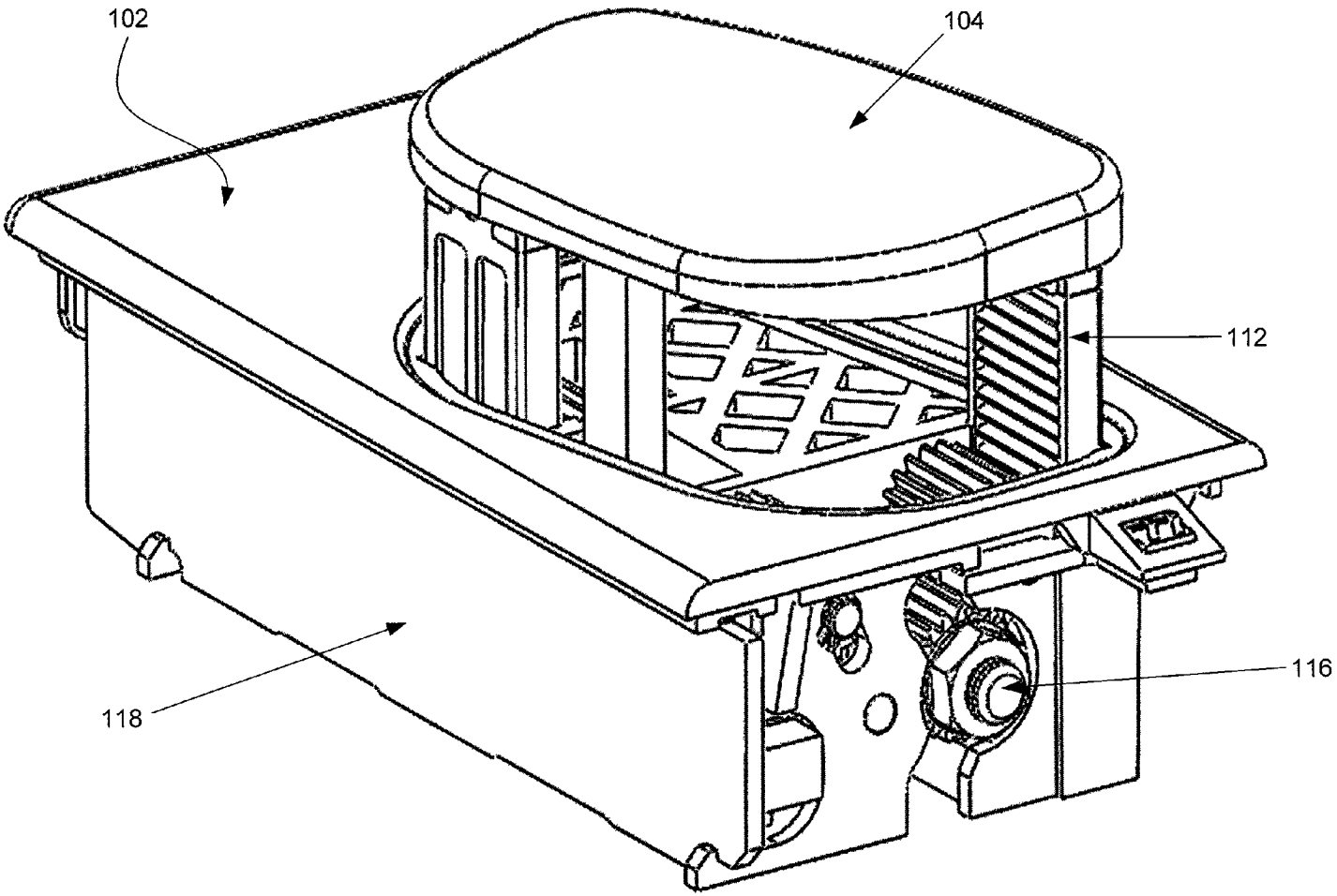
FIG. 3 illustrates various components of an actuator portion of a foot compression system in accordance with an exemplary embodiment.

Turning now to FIGS. 2A through 3, and in accordance with an exemplary embodiment, pressure pad 104 comprises a rigid or semi-rigid structure configured to press against a person's foot. Pressure pad 104 is coupled to main gears 112. Pressure pad 104 may be made of metal, plastic, composite, and/or the like. Moreover, pressure pad 104 may be comprised of any material suitable for transferring force to a person's foot. Additionally, pressure pad 104 can be any size to transfer force to a person's foot. According to an exemplary embodiment, pressure pad 104 applies force directly to the arch region of the foot. In various exemplary embodiments, pressure pad 104 comprises a contact surface area in the range of about 6 square centimeters to about 24 square centimeters. In various exemplary embodiments, pressure pad 104 comprises a contact surface area in the range of about 10 square centimeters to about 30 square centimeters. In other exemplary embodiments, pressure pad 104 comprises a contact surface area in the range of about 15 square centimeters to about 18 square centimeters. However, pressure pad 104 may be configured with any appropriate dimensions, surfaces, angles, and/or components, as desired, in order to transfer force to a foot.

In various exemplary embodiments, pressure pad 104 further comprises a pressure sensor (not shown) configured to measure the pressure generated by pressure pad 104. The pressure sensor may communicate with control electronics 118 and/or other components of foot compression system 100 in order to achieve a desired level of pressure generated by pressure pad 104.

In an exemplary embodiment, when extended away from main housing 102, pressure pad 104 presses against the venous plexus region of the foot. Pressure pad 104 compresses the veins both in the arch of the foot and across the top of the foot from approximately the metatarsal-phalangeal joints to the talus. In various exemplary embodiments, pressure pad 104 is pressed against the venous plexus region of the foot for a time between approximately 1 and 5 seconds. In another exemplary embodiment, pressure pad 104 is pressed against the venous plexus region of the foot for approximately 2 seconds. Moreover, pressure pad 104 may be pressed against the venous plexus region for the foot for any suitable time to stimulate blood flow.

In an exemplary embodiment, pressure pad 104 retracts so that it is flush or nearly flush with an outer surface of main housing 102. Compression and relaxation is then followed by a period of non-compression to allow the veins within the venous plexus to re-fill with blood. In various exemplary embodiments, pressure pad 104 is pressed against the venous plexus region of the foot and then retracted in regular intervals of between about 20 seconds to about 45 seconds. In another exemplary embodiment, pressure pad 104 is pressed against the venous plexus region of the foot and then retracted in regular intervals of about 30 seconds. Further, pressure pad 104 may be pressed against the venous plexus region of the foot and then retracted in any suitable interval to stimulate blood flow. For example, compression may be rapid in order to move blood through the veins of the lower leg at an elevated velocity and to release chemical compounds that reduce pain.

In accordance with an exemplary embodiment, switches and/or other appropriate mechanisms may be located at the maximum and/or minimum extensions of pressure pad 104 in order to prevent electric motor 106 from attempting to force pressure pad 104 beyond the end of travel. Such switches or other travel-limiting devices may be implemented mechanically, in hardware, in software, or any combination of the foregoing.

Figure 4A:
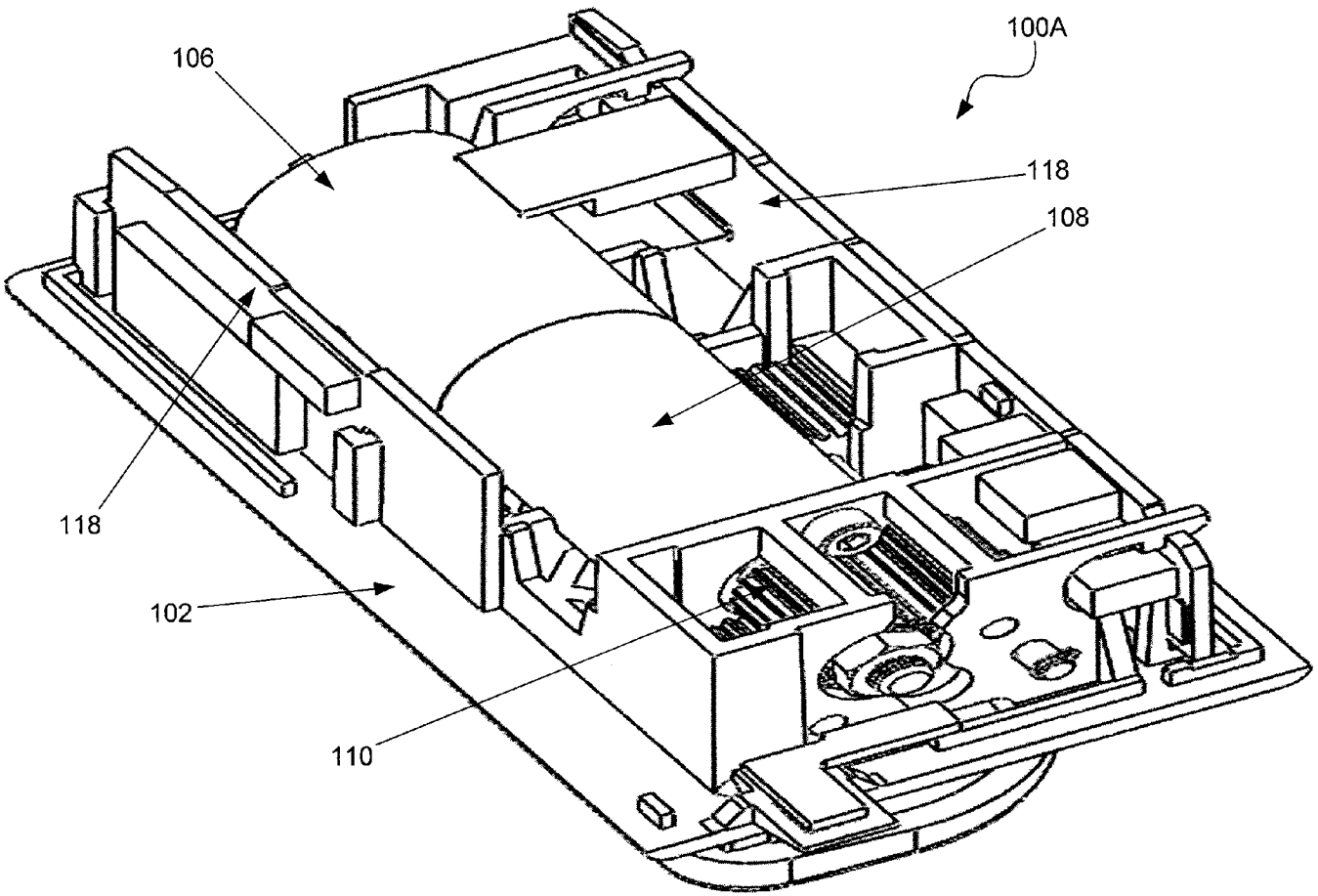
FIGS. 4A through 4C illustrate various components of an actuator portion of a foot compression system in accordance with an exemplary embodiment.
Figure 4B:
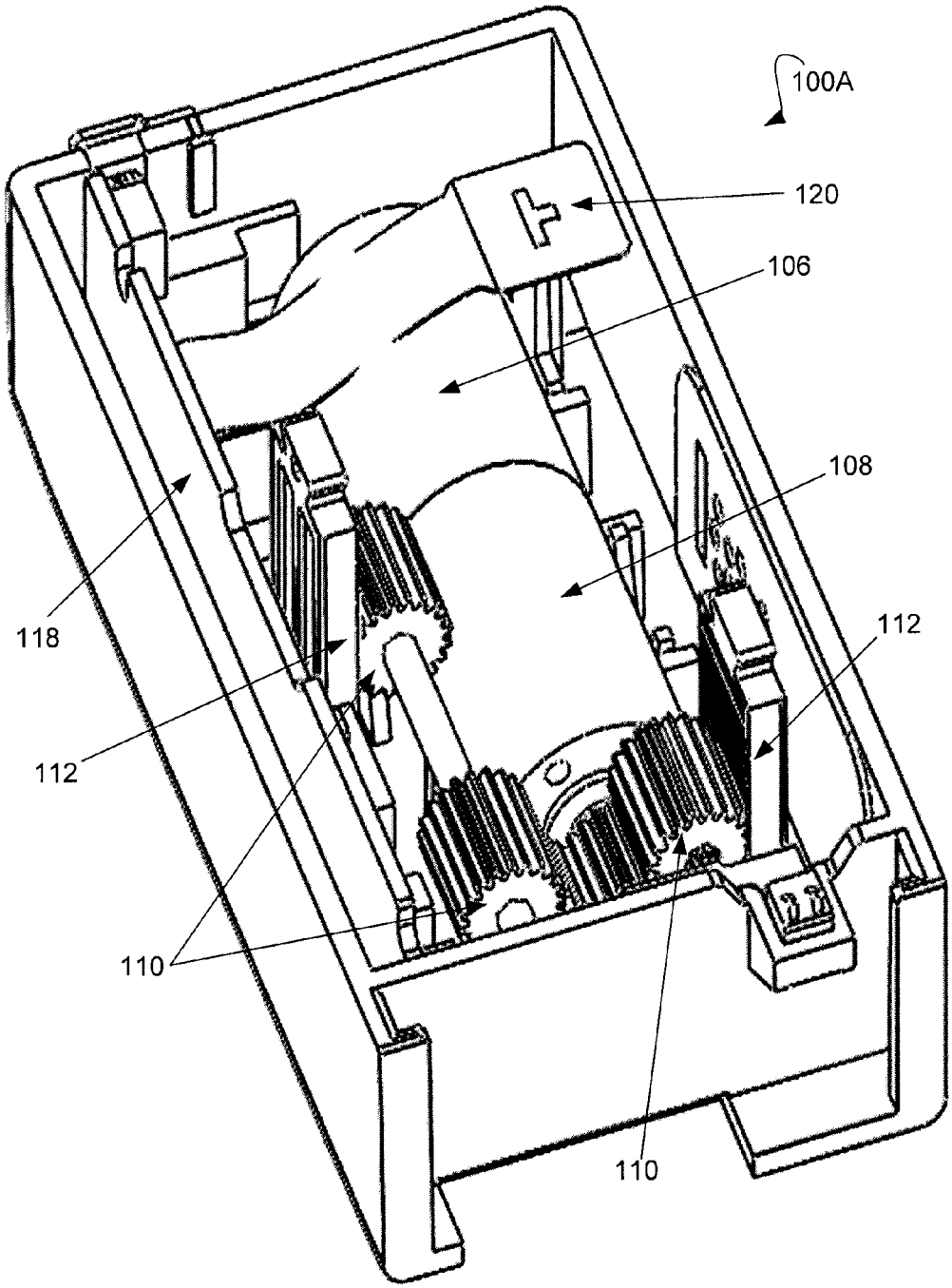
Figure 4C:
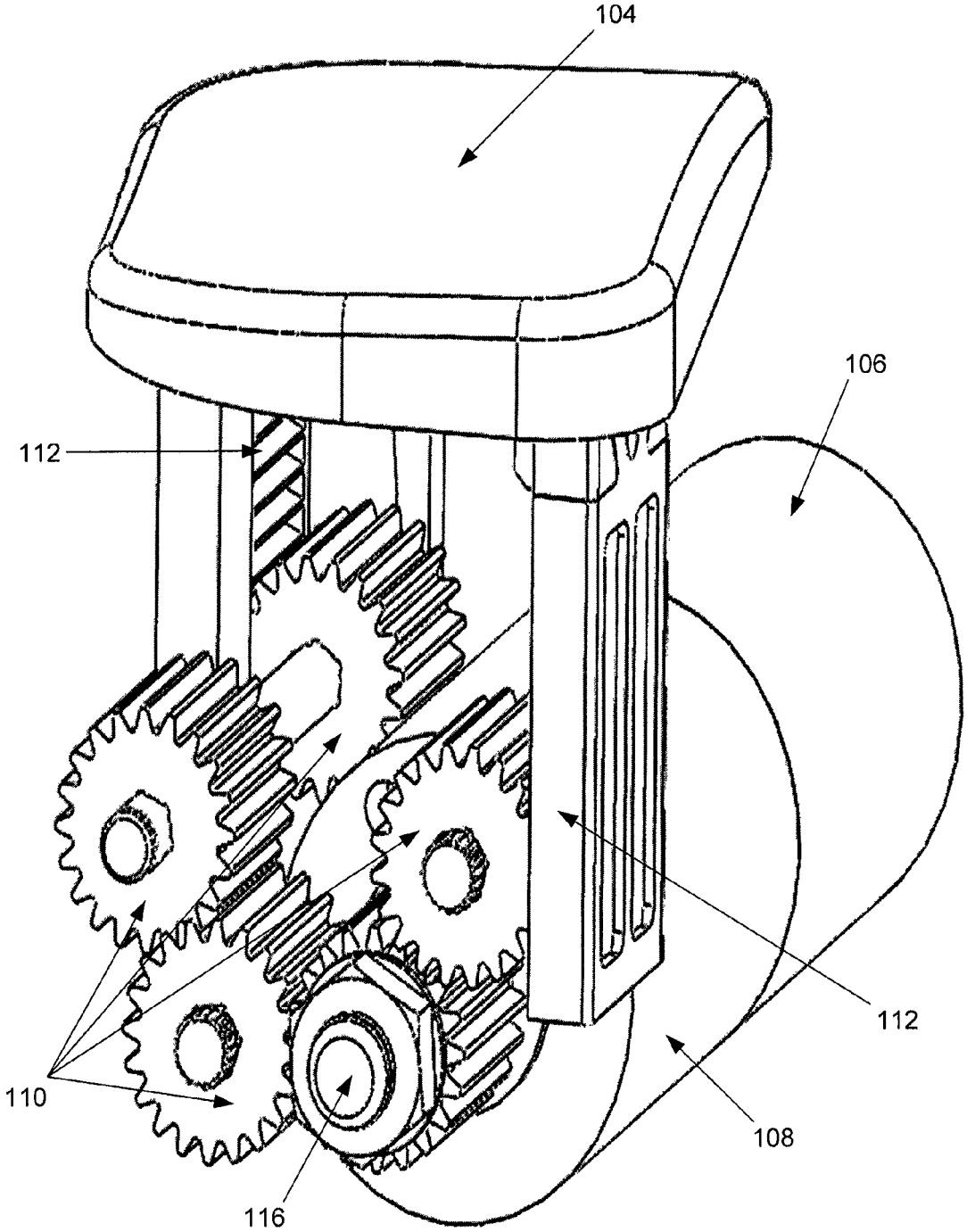

Electric motor 106 may be any component configured to generate mechanical force to move pressure pad 104. With reference now to FIGS. 4A through 4C, and in accordance with an exemplary embodiment, electric motor 106 comprises a rotary output shaft driving a pinion. Electric motor 106 may comprise any suitable motor, such as a brushless direct current (DC) motor, a brushed DC motor, a coreless DC motor, a linear DC motor, and/or the like. Moreover, any motor, actuator, or similar device presently known or adopted in the future to drive moving parts within foot compression system 100 falls within the scope of the present disclosure. In various other exemplary embodiments, electric motor 106 may be replaced with another suitable power generation mechanism capable of moving pressure pad 104, such as an artificial muscle, a piezoelectric material, and the like. Electric motor 106 is coupled to gearbox 108.

With continued reference to FIGS. 4A through 4C, and in accordance with an exemplary embodiment, gearbox 108 comprises a mechanism configured to increase the mechanical advantage obtained by motor 106, for example a reduction gearbox. Gearbox 108 is coupled to electric motor 106 and to output gears 110. Output force from electric motor 106 is transferred through gearbox 108 in order to achieve an appropriate gear ratio for effectuating movement of pressure pad 104. Thus, gearbox 108 may have a fixed gear ratio. Alternatively, gearbox 108 may have a variable or adjustable gear ratio. Gearbox 108 may comprise any suitable ratio configured in any suitable matter to effectuate movement of pressure pad 104. Moreover, gearbox 108 may comprise any suitable components, configurations, ratios, mechanisms, and/or the like, as desired, in order to transfer output force from motor 106 to other components of foot compression system 100, for example output gears 110

Output gears 110 may comprise any mechanism configured to transfer force from gearbox 108 to main gears 112. Continuing to reference FIGS. 4A through 4C, in accordance with an exemplary embodiment, output gears 110 comprise metal, plastic, or other durable material. Output gears 110 are coupled to gearbox 108 and to main gears 112. Output force from electric motor 106 is transferred through gearbox 108 to output gears 110. Output gears 110 are further configured to interface with main gears 112. Moreover, output gears 110 may comprise any composition or configuration suitable to transfer force to main gear 112.

Main gears 112 may comprise any suitable component or structure configured to effectuate movement of pressure pad 104. As illustrated in FIGS. 4A through 4C, in an exemplary embodiment, one or more main gears 112 are coupled to pressure pad 104. Main gears 112 interface with output gear 110. As main gears 112 move in response to force transferred by output gears 110, pressure pad 104 is extended and/or retracted through its range of motion. In various exemplary embodiments, main gears 112 are configured to effectuate movement of pressure pad 104 a distance of between about 1 mm to about 24 mm from a fully retracted to a fully extended position. In various other exemplary embodiments, main gears 112 are configured to effectuate movement of pressure pad 104 a distance of between about 12 mm to about 24 mm from a fully retracted to a fully extended position. Moreover, movement of pressure pad 104 may vary based on an individual user. For example, pressure pad 104 may be extended a larger distance for a user having a higher foot arch, and a smaller distance for a user having a lower foot arch. Additionally, pressure pad 104 may be moved between a fully retracted and a partially extended position, for example if a desired pressure value is reached via partial extension of pressure pad 104. Pressure pad 104 may also move responsive to operation of slip clutch 116.

With reference to FIGS. 4A through 4C, slip clutch 116 may comprise any mechanism configured to prevent damage to electric motor 106 and/or injury to a person. For example, if a person applies excessive force or weight to their foot when pressure pad 104 is extended, slip clutch 116 allows pressure pad 104 to safely retract back towards main housing 102. In an exemplary embodiment, slip clutch 116 is a friction clutch. Slip clutch 116 is configured to slip when excessive force is placed on pressure pad 104. In various exemplary embodiments, slip clutch 116 is configured to slip when the force on pressure pad 104 exceeds between about 130 Newtons to about 200 Newtons. In another exemplary embodiment, slip clutch 116 is configured to slip when the force on pressure pad 104 exceeds 155 Newtons. Moreover, slip clutch 116 may be configured to slip responsive to any suitable force in order to prevent damage to electric motor 106 or other components of foot compression system 100 and/or injury to a person.

In various exemplary embodiments, foot compression system 100 may be at least partially operated, controlled, and/or activated by one or more electronic circuits, for example control electronics 118. In accordance with an exemplary embodiment, control electronics 118 and/or an associated software subsystem comprise components configured to at least partially control operation of foot compression system 100. For example, control electronics 118 may comprise integrated circuits, discrete electrical components, printed circuit boards, and/or the like, and/or combinations of the same. Control electronics 118 may further comprise clocks or other timing circuitry. Control electronics 118 may also comprise data logging circuitry, for example volatile or non-volatile memories and the like, to store data, such as data regarding operation and functioning of foot compression system 100. Moreover, a software subsystem may be pre-programmed and communicate with control electronics 118 in order to adjust various variables, for example the time that pressure pad 104 remains in an extended position, the pressure applied to the foot, intervals of travel between the extended and retracted positions of pressure pad 104, the time it takes for pressure pad 104 to extend to the extended position and retract to a recessed position, and/or the like.

Control electronics 118 may be configured to store data related to foot compression system 100. For example, in various exemplary embodiments, control electronics 118 may record if foot compression system 100 is mounted to the foot of a person and active, if foot compression system 100 is mounted to the foot of a person and inactive, if foot compression system 100 is not mounted to the foot of a person and system 100 is inactive, and/or the like and/or combinations of the same. Further, control electronics 118 may record the duration foot compression system 100 is active, the number of compression cycles performed, one or more pressures generated by foot compression system 100, and so forth. Moreover, control electronics 118 may further comprise circuitry configured to enable data stored in control electronics 118 to be retrieved for analysis, deleted, compacted, encrypted, and/or the like.

In accordance with an exemplary embodiment, when pressure pad 104 is being extended or is in a fully extended state, control electronics 118 may monitor the pressure applied by pressure pad 104. For example, control electronics 118 may monitor the current drawn by electric motor 106 and calculate the applied pressure. Alternatively, a pressure sensor may detect the applied pressure and report this value to control electronics 118 and/or an associated software subsystem.

In various exemplary embodiments, pressure pad 104 may be extended until a pressure threshold, such as between about 1 mmHg and 500 mmHg, is reached. In other exemplary embodiments, pressure pad 104 may be extended until a pressure threshold of between about 300 mmHg and 465 mmHg is reached. Alternatively, pressure pad 104 may be extended until pressure pad 104 is at the point of maximum extension from main housing 102. In various exemplary embodiments, pressure pad 104 is extended with a force of between 50 Newtons and 115 Newtons. In other exemplary embodiments, pressure pad 104 is extended with a force of between 75 Newtons and 100 Newtons. While various pressures and/or forces have been described herein, other pressures and/or forces can be applied and fall within the scope of the present disclosure. Moreover, switches and/or other devices may be placed at the locations of maximum and/or minimum extension of pressure pad 104 in order to ensure that electric motor 106 is appropriately shut off at the end of travel.

With reference to FIG. 4B, in accordance with an exemplary embodiment, weight sensor 120 is provided within main housing 102. Weight sensor 120 comprises any suitable sensor configured to detect weight applied to main housing 102. When weight sensor 120 detects a suitable amount of weight, such as 25 pounds or more, electronic controls 118 may infer that the person is walking or otherwise putting pressure on actuator portion 100A. Moreover, any appropriate weight may be utilized, and thus falls within the scope of the present disclosure. Accordingly, electronic controls 118 may implement a delay in activating foot compression system 100 to ensure the person does not walk on the raised pressure pad 104.

With reference now to FIGS. 2A and 2B, in an exemplary embodiment, actuator portion 100A may further comprise one or more indicators 119. Indicators 119 may comprise any components configured to receive input from a user and/or to deliver feedback to a user. For example, indicators 119 may comprise on/off buttons, lights, switches, and/or the like. In an exemplary embodiment, indicators 119 comprise a power button, a "high" foot compression setting light, a "low" foot compression setting light, a battery level warning light, and an error message light. Moreover, indicators 119 may comprise any suitable input and/or output components, as desired.

With continued reference to FIGS. 2A and 2B, in accordance with an exemplary embodiment, actuator portion 100A further comprises a removable battery 131. Battery 131 may comprise electrochemical cells suitable to provide power for actuator portion 100A. Battery 131 may be rechargeable, but may also be single-use. Batteries 131 may comprise alkaline, nickel-metal hydride, lithium-ion, lithium-polymer, and/or other battery configurations suitable for powering actuator portion 100A. Moreover, battery 131 may comprise any suitable chemistry, form factor, voltage, and/or capacity suitable to provide power to actuator portion 100A. As illustrated, battery 131 may be decoupled from main body 102, for example to facilitate recharging of battery 131, as desired.

In various exemplary embodiments, foot compression system 100 may further comprise a motion sensor or other components configured to detect movement of foot compression system 100. Control electronics 118 may prevent operation of actuator portion 100A unless the motion sensor reports actuator portion 100A (and thus, typically, the limb to which actuator portion 100A is mounted) has been substantially motionless for a period of time, such as between about 2 minutes and 10 minutes. Further, any appropriate time range is thought to fall within the scope of the present disclosure as the ranges set forth herein are exemplary only.

Figure 5:
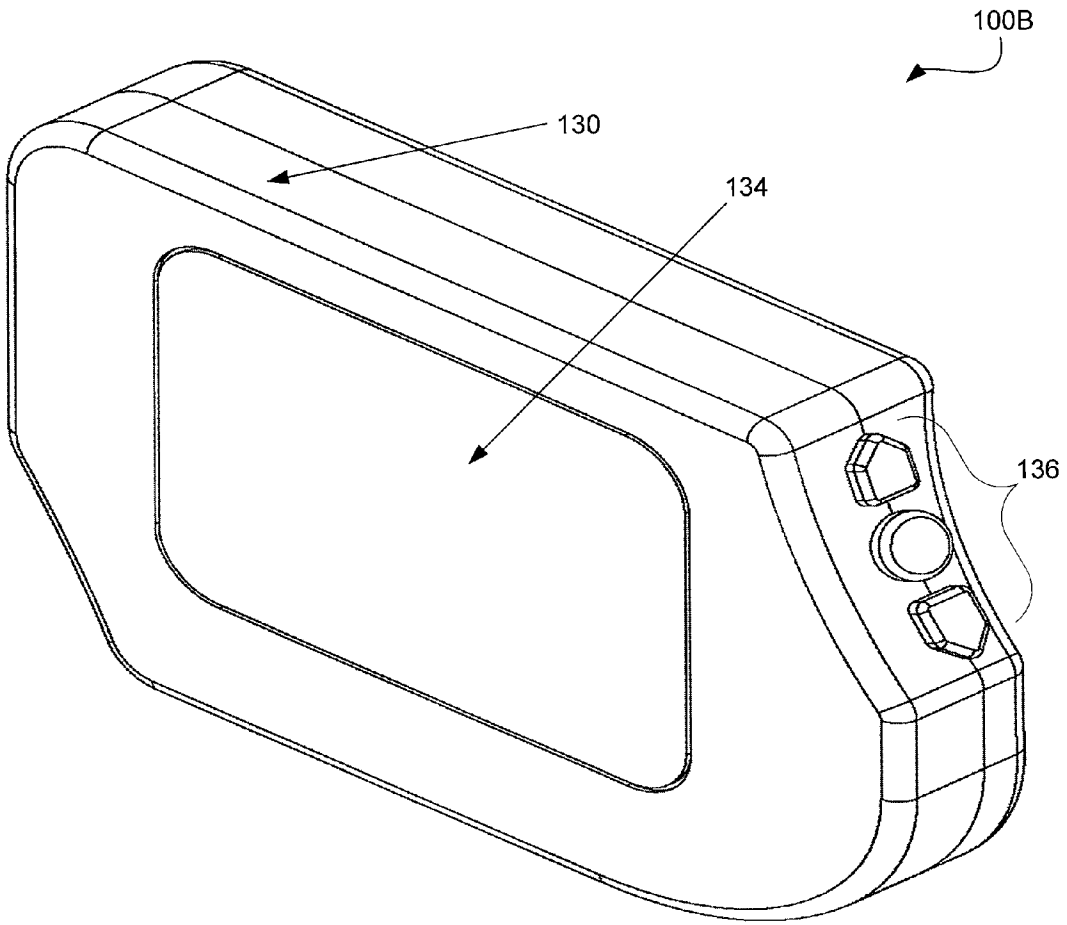
FIG. 5 illustrates a reader portion of a foot compression system in accordance with an exemplary embodiment.

With reference now to FIGS. 1 and 5, and in accordance with an exemplary embodiment, foot compression system 100 comprises a reader portion 100B configured to facilitate communication with and/or control of actuator portion 100A and/or other components of foot compression system 100. Reader portion 100B may comprise any suitable components, circuitry, displays, indicators, and/or the like, as desired.

For example, in an exemplary embodiment, reader portion 100B is used to control and program foot compression system 100. Reader portion 100B may be configured with a control box 130 comprising metal, plastic, composite, or other durable material suitable to contain various components of reader portion 100B. In an exemplary embodiment, reader portion 100B is coupled to actuator portion 100A via a cable, for example an electrical cable suitable to carry current to drive electric motor 106, carry digital signals, carry analog signals, and/or the like. In other exemplary embodiments, reader portion 100B and actuator portion 100A communicate wirelessly. In these embodiments, reader portion 100B and actuator portion 100A may further comprise transceivers, receivers, transmitters and/or similar wireless technology.

In accordance with an exemplary embodiment, reader portion 100B may comprise one or more batteries 132 (not shown in figures). Batteries 132 may comprise electrochemical cells suitable to provide power for reader portion 100B. Batteries 132 may be rechargeable, but may also be single-use. Batteries 132 may comprise alkaline, nickel-metal hydride, lithium-ion, lithium-polymer, or other battery configurations suitable for powering reader portion 100B. Moreover, batteries 132 may comprise any suitable chemistry, form factor, voltage, and/or capacity suitable to provide power to reader portion 100B.

Batteries 132 may be recharged via an external charger. Batteries 132 may also be recharged by use of electronic components within reader portion 100B. Alternatively, batteries 132 may be removed from reader portion 100B and replaced with fresh batteries.

With reference now to FIG. 5, and in accordance with an exemplary embodiment, reader portion 100*b* further comprises a display 134 configured for presenting information to a user. In an exemplary embodiment, display 134 comprises a liquid crystal display (LCD). In other exemplary embodiments, display 134 comprises light emitting diodes (LEDs). In still other exemplary embodiments, display 134 comprises visual and audio communication devices such as speakers, alarms, and/or other similar monitoring and/or feedback components. Moreover, display 134 may also comprise audible or tactile feedback components. Display 134 is configured to provide feedback to a system user. Moreover, display 134 may comprise any suitable components configured to provide information to a system user.

With continued reference to FIG. 5, inputs 136 may comprise any components configured to allow a user to control operation of foot compression system 100. In an exemplary embodiment, inputs 136 allow a user to turn foot compression system 100 on and off. Inputs 136 may also allow a user to adjust operating parameters of foot compression system 100, for example the interval of extension of pressure pad 104, the force with which pressure pad 104 is extended, the maximum pressure applied by pressure pad 104, various time intervals to have pressure pad 104 in an extended or retracted position, and/or the like. Further, inputs 136 may allow retrieval of data, such as system usage records. Data may be stored in actuator portion 100A, for example in control electronics 118, as well as in reader portion 100B, as desired.

In an exemplary embodiment, inputs 136 comprise electronic buttons, switches, or similar devices. In other exemplary embodiments, inputs 136 comprise a communications port, for example a Universal Serial Bus (USB) port. Further, inputs 136 may comprise variable pressure control switches with corresponding indicator lights. Inputs 136 may also comprise variable speed control switches with corresponding indicator lights, on/off switches, pressure switches, click wheels, trackballs, d-pads, and/or the like. Moreover, inputs 136 may comprise any suitable components configured to allow a user to control operation of foot compression system 100.

In accordance with an exemplary embodiment, foot compression system 100 is configured to be inserted into normal, off-the-shelf shoes, sandals, and other footwear. In various exemplary embodiments, pressure pad 104 is moved from the fully retracted position to the fully extended position in a time between about one-tenth (0.1) second and 1 second. In other exemplary embodiments, pressure pad 104 moves from the fully retracted position to the fully extended position in a time between about one-tenth (0.1) seconds and about three-tenths (0.3) seconds. Moreover, variances in individual feet (e.g., height of arch, curvature of arch, width, length, and/or the like) may effect the time period over which pressure pad is deployed.

In accordance with an exemplary embodiment, when moved to the fully extended position, pressure pad 104 may generate a pressure between about 1 mmHg and 500 mmHg against the person's foot. Further, pressure pad 104 may be extended with a force between about 50 Newtons and 115 Newtons in certain exemplary embodiments. Pressure pad 104 may be kept in an extended position for a time between about 1 and 3 seconds. Pressure pad 104 is then retracted. Pressure pad 104 may then be re-extended, such as after a delay of between about 20 and 45 seconds. However, other time frames can be used, and all time frames are thought to fall within the scope of the present disclosure.

While specific time ranges, sizes, pressures, movement distances, and the like have been described herein, these values are given purely for example. Various other time ranges, sizes, pressures, distances, and the like can be used and fall within the scope of the present disclosure. Any device configured to apply pressure to a person's foot as set forth herein is thought to fall within the scope of the present disclosure.

The present disclosure has been described above with reference to various exemplary embodiments. However, those skilled in the art will recognize that changes and modifications may be made to the exemplary embodiments without departing from the scope of the present disclosure. For example, the various operational steps, as well as the components for carrying out the operational steps, may be implemented in alternate ways depending upon the particular application or in consideration of any number of cost functions associated with the operation of the system, e.g., one or more of the steps may be deleted, modified, or combined with other steps. Further, it should be noted that while the methods and systems for compression described above are suitable for use on the foot, similar approaches may be used on the hand, calf, or other areas of the body. These and other changes or modifications are intended to be included within the scope of the present disclosure.

Moreover, as will be appreciated by one of ordinary skill in the art, principles of the present disclosure may be reflected in a computer program product on a tangible computer-readable storage medium having computer-readable program code means embodied in the storage medium. Any suitable computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create means for implementing the functions. These computer program instructions may also be stored in a computer-readable memory that can direct a computer or other programmable data processing apparatus to function in a particular manner, such that the instructions stored in the computer-readable memory produce an article of manufacture including instruction means which implement the function specified. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified.

In the foregoing specification, the disclosure has been described with reference to various embodiments. However, one of ordinary skill in the art appreciates that various modifications and changes can be made without departing from the scope of the present disclosure as set forth in the claims below. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. Further, when language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A method of compressing a foot to reduce the occurrence of venous thromboembolism, the method comprising, moving, via an electric motor, a semi-rigid pressure pad a first time to bring the semi-rigid pressure pad into contact with a foot to compress a portion of the foot, wherein the semi-rigid pressure pad and the electric motor are completely contained within a shoe;

moving, via the electric motor, the semi-rigid pressure pad a second time to bring the semi-rigid pressure pad out of contact with the foot to allow the portion of the foot to at least partially refill with blood; and moving, via the electric motor, the semi-rigid pressure pad a third time to bring the semi-rigid pressure pad into contact with the foot to force at least a portion of the blood out of the portion of the foot; wherein the electric motor moves the semi-rigid pressure pad responsive to inactivity of the foot for a predetermined time period.

2. The method of claim 1, wherein the semi-rigid pressure pad generates an applied pressure of between 100 mmHg and 465 mmHg when brought into contact with a foot.

3. The method of claim 1, wherein the portion of the semi-rigid pressure pad that contacts the foot has a contact surface area of between about 10 square centimeters to about 30 square centimeters.

4. The method of claim 1, wherein the semi-rigid pressure pad is placed within an item of footwear.

5. The method of claim 1, wherein the portion of the foot is the venous plexus region.

6. The system of claim 1, wherein the foot compression transmits data via wireless communication.

7. A foot compression system configured to deliver a compressive force to the venous plexus region of the foot, the foot compression system comprising:

a retractable, semi-rigid pressure pad;

a electric motor coupled to the semi-rigid pressure pad via a gear, wherein the motor is configured to move the semi-rigid pressure pad in and out of contact with a foot, and wherein the electric motor moves the semi-rigid pressure pad into and out of contact with the foot at set time intervals that are pre-programmed within the electric motor; and a slip clutch coupling the semi-rigid pressure pad and the electric motor, the slip clutch configured to allow the semi-rigid pressure pad to retract responsive to an applied force exceeding a predetermined value, wherein the foot compression system is completely contained within a shoe, and wherein the semi-rigid pressure pad remains in a fully retracted position when the foot is used to walk.

8. A method of treatment, the method comprising:

extending a semi-rigid pressure pad, via an electric motor, into contact a first time with the venous plexus region of a foot to apply a pressure to the venous plexus region of the foot, wherein the semi-rigid pressure pad and the electric motor are both completely contained within a shoe;

monitoring, via a pressure sensor, the pressure resulting from the contact;

stopping, via the electric motor, extension of the semi-rigid pressure pad responsive to the monitored pressure exceeding 100 mmHg;

holding the semi-rigid pressure pad in contact with the venous plexus region of the foot for a period exceeding 1 second;

retracting the semi-rigid pressure pad, via the electric motor, out of contact with the foot; and extending, via the electric motor, the semi-rigid pressure pad, into contact a second time with the venous plexus region of the foot, wherein the extending the second time is responsive to an elapsed time from the retracting exceeding 15 seconds.

9. The method of claim 8, wherein extending the non-deformable pressure pad does not move any portion of the semi-rigid pressure pad in a direction perpendicular to the direction of extension.

10. The method of claim 8, wherein extending the non-deformable pressure pad moves the semi-rigid pressure pad solely in the direction of extension.

11. The method of claim 8, wherein extending the semi-rigid pressure pad the first time occurs responsive to a sensor not sensing a predetermined weight during a predetermined time.

12. The method of claim 8, further comprising retracting, via a slip clutch, the semi-rigid pressure pad responsive to a force exceeding 130 Newtons exerted on the semi-rigid pressure pad.

13. The method of claim 12, wherein the force is exerted on the semi-rigid pressure pad by the foot being used to walk.

14. The method of claim 13, wherein the retracting causes the semi-rigid pressure pad to become flush with an outer surface of a foot compression system.

15. The method of claim 12, wherein the force is exerted on the semi-rigid pressure pad by the foot being used to stand.

16. The method of claim 8, wherein extending occurs when a user is not standing on the foot.

17. The method of claim 8, further comprising removing the semi-rigid pressure pad and the electric motor from the shoe, and installing the non-deformable pressure pad and the electric motor in another shoe.

18. The method of claim 8, wherein the semi-rigid pressure pad is extensible over a range from about 1 mm to about 24 mm in order to exert a pressure exceeding 100 mmHg on feet having varying arch height.

19. The method of claim 8, wherein the semi-rigid pressure pad does not contact the foot responsive to the foot being used to walk.

20. The method of claim 8, wherein extending the semi-rigid pressure pad the first time occurs responsive to a motion sensor not sensing motion of the shoe during an elapsed predetermined time period.

21. A method of reducing the occurrence of venous thromboembolism, the method comprising:

extending a semi-rigid pressure pad into contact a first time with a foot to apply a first pressure to the venous plexus region of the foot, wherein the semi-rigid pressure pad is extended a first distance to apply the first pressure, and wherein the semi-rigid pressure pad is completely contained within a shoe;

retracting the semi-rigid pressure pad out of contact with the foot; and extending the semi-rigid pressure pad into contact a second time with the foot to apply a second pressure to the foot, wherein the semi-rigid pressure pad is extended a second distance to apply the second pressure; and wherein the first extension and the second extension are configured to pump blood through veins in the foot when the foot is not being used to stand or walk, wherein the first distance and the second distance are selected responsive to varying distances between the foot and a fully retracted position of the semi-rigid pressure pad; and wherein the extending occurs responsive to the foot not being used to stand or walk for a predetermined period.

22. The method of claim 21, wherein the first distance and the second distance are selected to cause blood to flow through veins in the foot at a rate exceeding a predetermined rate.

23. The method of claim 21, wherein the semi-rigid pressure pad remains in the fully retracted position when the foot is used to walk.

* * * * *